US008083379B2

(12) United States Patent
Schulz et al.

(10) Patent No.: US 8,083,379 B2
(45) Date of Patent: Dec. 27, 2011

(54) REFLECTOR EMITTER

(75) Inventors: Jan Schulz, Bremerhaven (DE); Michael Potthoff, Helsingoer (DK)

(73) Assignee: Stiftung Alfred-Wegener-Institut fuer Polar- und Meeresforschung, Bremerhaven (DE)

( * ) Notice: Subject to any disclaimer, the term of this patent is extended or adjusted under 35 U.S.C. 154(b) by 321 days.

(21) Appl. No.: 12/440,765

(22) PCT Filed: Sep. 5, 2007

(86) PCT No.: PCT/DE2007/001597

§ 371 (c)(1),
(2), (4) Date: Mar. 11, 2009

(87) PCT Pub. No.: WO2008/031405

PCT Pub. Date: Mar. 20, 2008

(65) Prior Publication Data

US 2010/0020538 A1 Jan. 28, 2010

(30) Foreign Application Priority Data

Sep. 15, 2006 (DE) ..... 10 2006 044 019

(51) Int. Cl.
*F21V 7/00* (2006.01)

(52) U.S. Cl. ..... 362/300; 362/298; 362/346; 362/247

(58) Field of Classification Search ..... 362/298, 362/300, 302, 304, 517, 240, 241, 247, 346
See application file for complete search history.

(56) References Cited

U.S. PATENT DOCUMENTS

| | | | | |
|---|---|---|---|---|
| 3,628,852 | A * | 12/1971 | Snaper et al. | 359/849 |
| 5,178,446 | A | 1/1993 | Gruber et al. | |
| 5,219,444 | A * | 6/1993 | Chiaramonte et al. | 362/464 |
| 6,244,729 | B1 * | 6/2001 | Waldmann | 362/260 |
| 6,270,241 | B1 * | 8/2001 | Collot et al. | 362/544 |
| 6,425,677 | B1 * | 7/2002 | Chuang | 362/243 |
| 6,499,864 | B2 | 12/2002 | Luce | |
| 6,575,608 | B2 * | 6/2003 | Oyama et al. | 362/517 |
| 7,178,960 | B2 * | 2/2007 | Ishida | 362/545 |
| 7,207,705 | B2 * | 4/2007 | Ishida | 362/517 |
| 7,513,630 | B2 * | 4/2009 | Li | 359/853 |
| 2003/0016539 | A1 | 1/2003 | Minano et al. | |

(Continued)

FOREIGN PATENT DOCUMENTS

DE 202004009121 9/2004

(Continued)

*Primary Examiner* — David Crowe
(74) *Attorney, Agent, or Firm* — Leydig, Voit & Mayer, Ltd.

(57) ABSTRACT

A reflector emitter includes a combination reflector having at least one elliptical concave mirror shaped as an ellipsoid of revolution section having first and second focal points disposed outside and inside of the ellipsoid of revolution section, respectively. The reflector emitter includes at least one light source at the second focal point. The ellipsoid of revolution section is formed as an ellipsoid of revolution that is cut between its center and the first focal point in a longitudinal section plane and in a cross-sectional plane. An aperture is provided above an other concave mirror having at least one focal point that coincides with the first focal point of the ellipsoid of revolution section. The other concave mirror is formed as a hollow body cut in a sectional plane through its focal point. This sectional plane and the longitudinal section plane of the ellipsoid of revolution section share a common plane of reference and the concave mirrors have opposing faces.

13 Claims, 2 Drawing Sheets

U.S. PATENT DOCUMENTS

| | | | | |
|---|---|---|---|---|
| 2005/0036314 | A1 | 2/2005 | Kobayashi et al. | |
| 2005/0094402 | A1 * | 5/2005 | Albou | 362/297 |

FOREIGN PATENT DOCUMENTS

| | | |
|---|---|---|
| DE | 202005009814 | 10/2005 |
| DE | 202006004481 | 5/2006 |
| EP | 1152188 | 11/2001 |
| EP | 1557605 | 7/2005 |
| FR | 2718825 | 0/1995 |
| FR | 2669991 | 6/1992 |
| GB | 173243 | 12/1921 |
| JP | 11064795 | 3/1999 |

* cited by examiner

REFLECTOR EMITTER

CROSS REFERENCE TO PRIOR APPLICATIONS

This application is a U.S. National Phase application under 35 U.S.C. §371 of International Application No. PCT/DE2007/001597, filed on Sep. 5, 2007, and claims benefit to German Patent Application No. DE 10 2006 044 019.6, filed on Sep. 15, 2006. The International Application was published in German on Mar. 20, 2008 as WO 2008/031405 under PCT Article 21(2).

FIELD

The present invention relates to a reflector emitter for producing a directed light beam having a combination reflector composed of at least one elliptical concave mirror in the form of an ellipsoid of revolution section, one further concave mirror, as well as an aperture, and having a light source in a focal point of the ellipsoid of revolution section.

BACKGROUND

The French Patent Application FR 2 718 825 A1 describes a reflector lamp assembly that includes a non-closed system of two mirrors which focuses a specific light component into a glass fiber. The configuration of the small partial mirrors permits a variable angle of emergence from the lamp assembly. However, it does not follow the principle whereby the focal points of elliptical and other concave mirrors are brought into correspondence with the aperture and is, therefore, not primarily designed for a high output. The lamp assembly has only one single lamp and constitutes a substantially punctiform light source. In U.S. patent application Ser. No. 2005/0036314 A1, a projector is described whose illuminating device is a reflector lamp assembly having symmetrically arranged mirrors. The elliptical concave mirror is located behind the lamp; the other concave mirror is a small-diameter, spherical half shell which is directly contiguous to the spherical lamp. The aim here is to achieve a higher output by positioning the center of the lamp in the first focal point of the ellipse. Moreover, the configuration does not permit any beams that fall directly outside of the two mirrors. However, a significant light component is absorbed by the lamp socket that extends through the two mirrors. Here as well, the lamp assembly has only one single lamp. In Japanese Patent JP 11064795, a reflector lamp assembly is described where the light source is configured as a point source in the first focal point of the elliptical concave mirror and is terminated by another, spherical concave mirror having a very large aperture which is directly followed by a contiguous optical lens. Here as well, light losses occur as a result of the lamp socket which extends through the elliptical concave mirror which also prevents radiation from being transmitted directly to the second focal point. In this configuration, the light is scattered by the upstream lens prior to reaching the second focal point, and a bundle of parallel beams is produced. U.S. patent application Ser. No. 2003/0016539 A1 discusses reflectors which are made of solid bodies having two differently shaped and at least partially mirrorized surfaces. An optimized beam guidance is achieved by the surface shapes, while a compact reflector design is provided at the same time. Either a receiver for incoming radiation or a source for outgoing radiation can be located in the focal point. The reflectors are provided for emitters having exclusively one central light source or, conversely, for receivers having exclusively one focal point.

British Patent GB 173,243 illustrates an automotive headlamp which is composed of two opposing mirrors, the configuration of elliptical and of other spherical concave mirrors, where the center of the spherical shell and of the lamp resides in the first focal point of the ellipsoid of revolution, substantially prevents a light loss. Only the lamp socket causes a loss. The aperture is shaped in such a way that a light cone is formed that is especially advantageous for automotive headlamps in that it is intended to prevent glare to drivers of oncoming vehicles. The reflector lamp assembly is composed of a combination reflector of an elliptical concave mirror in the form of an ellipsoid of revolution section that is symmetrically disposed relative to the connecting line between the focal points of the ellipsoid of revolution as an axis of rotation, a further concave mirror in the form of a spherical shell segment having a radius which corresponds to the distance measure between the focal points of the ellipsoid of revolution, and a central aperture, the further concave mirror being configured relative to the elliptical concave mirror in such a way that the origin of the radius of the spherical shell coincides with the first focal point of the ellipsoid of revolution, and the center of the central aperture coincides with the second focal point of the ellipsoid of revolution, and with a light source in the first focal point of the ellipsoid of revolution.

The known reflector emitters are formed from rotationally symmetric arrangements and each have only one single light source. Depending on the application case, this type of construction calls for a bright, powerful lamp. This type of construction does not provide an approach for designing a light source as an arrangement of a plurality of lower-luminosity lamps.

Reflector emitters having LEDs as a light source are described in the technical literature. The German Utility Model Patent DE 20 2006 004 481 U1 discusses an illuminating device having an LED floodlight which is composed of an array of individual lens-focused LEDs, is located on a mast, and radiates upwards. A number of flat and partially movable mirrors, which reflect the light onto a ground area of a determinable size and position, are mounted above the LED floodlight. This illuminating device is not suited for sharp, parallel beam focusing and can be used for street lighting. No additional focusing mirrors are needed for its intended application, and scattering is accepted. The German Utility Model Patent DE 20 2004 009 121 UI describes a headlight having a plurality of individually accommodated LEDs whose light is focused by parabolic mirrors and specially oriented diffuser disks. This system is also unsuited for sharp, parallel beam focusing and is used for vehicle headlights.

SUMMARY

In an embodiment, the present invention provides a reflector emitter including a combination reflector having at least one elliptical concave mirror shaped as an ellipsoid of revolution section. The ellipsoid of revolution section has the form of an ellipsoid of revolution that is cut between its center and first focal point in a longitudinal section plane extending through the focal points and in a cross-sectional plane perpendicular to a line connecting the focal points such that the ellipsoid of revolution has its first and second focal points disposed outside and inside of the ellipsoid of revolution section, respectively. The reflector emitter is provided with at least one light source at the second focal point. An other concave mirror having at least one focal point that coincides with the first focal point of the ellipsoid of revolution section is also provided. This other concave mirror having form of a hollow body cut in a sectional plane through its focal point.

The longitudinal section plane of the ellipsoid of revolution section and the sectional plane of the other concave mirror are disposed in a common plane of reference and the concave mirrors have opposing faces. An aperture is disposed vertically above the other concave mirror.

BRIEF DESCRIPTION OF THE DRAWINGS

To aid in the further understanding of the present invention, refinements of the reflector emitter according to the present invention are clarified in greater detail in the following with reference to the schematic figures, which show.

DETAILED DESCRIPTION

Figure 1:
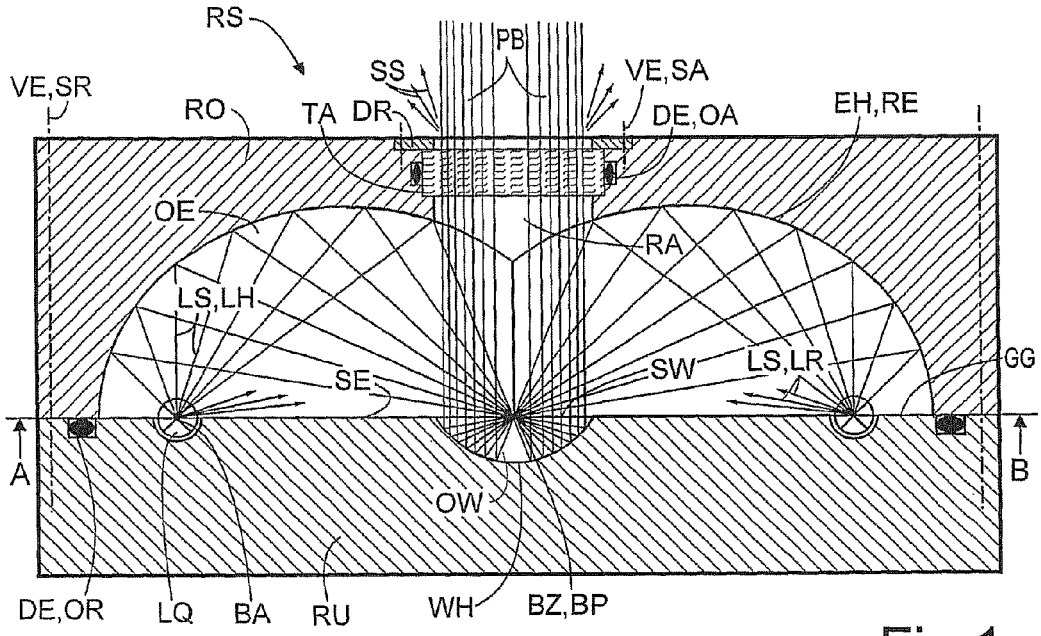
FIG. 1 shows a reflector emitter having two elliptical concave mirrors in cross section.

Reflector emitters of this kind have an especially high luminous efficiency and are characterized by low scattering losses. All of the light beams that emanate from the light source and strike the elliptical concave mirror, which is in the form of an ellipsoid of revolution section, are reflected onto the second focal point of the ellipsoid of revolution and are directed from there to the further concave mirror. This reflects the light in a shaped beam out through the aperture. Systems of this kind can be used for applications where a high luminous efficiency is advantageous in the context of predefined angles of radiation.

In an embodiment of the present invention, a reflector emitter which is designed for producing a strong, parallel directed light beam using a plurality of lower-luminosity lamps is provided. Moreover, it is intended that the reflector emitter be able to be produced simply and inexpensively.

In the case of the reflector emitter according to an embodiment of the present invention, the ellipsoid of revolution section is formed from an ellipsoid of revolution that is cut between its center and one of its focal points, both in the longitudinal section plane extending through the two focal points, as well as by a cross-sectional plane disposed perpendicularly to the connecting line between the two focal points. The other concave mirror is formed from any given hollow body that has at least one focal point and is cut in a sectional plane by the focal point. The longitudinal section plane of the ellipsoid of revolution section and the sectional plane of the other concave mirror are disposed in a common plane of reference; the concave mirror faces are configured to oppose one another; and the focal point situated outside of the ellipsoid of revolution section and the focal point of the further concave mirror coincide. The light source is configured in the focal point located within the ellipsoid of revolution section, and the aperture is configured vertically above the other concave mirror. All of the light beams, which emanate from the light source in the focal point located within the elliptical mirror in the form of the ellipsoid of revolution section, strike the surface of the elliptical mirror, are reflected at the focal point located outside of the ellipsoid of revolution section, and are routed from there to the other concave mirror. Here, the light beams are deflected in such a way that they form a shaped bundle which, after passing through the aperture located in the beam path behind the other concave mirror, exit the reflector emitter perpendicularly to the plane of reference. An embodiment of the reflector emitter according to the present invention provides for the light source in the focal point located within the ellipsoid of revolution section to be a light-emitting diode. Light-emitting diodes have a higher luminous efficiency than incandescent lamps. They do not get as hot, and they have a substantially longer service life.

In accordance with another embodiment of the reflector emitter according to the present invention, by configuring the two partial mirrors in one plane and not rotationally symmetrically, the combination reflector is able to have at least two ellipsoid of revolution sections which are located in the common plane of reference and are distributed around the other concave mirror in such a way that the focal points located outside of the ellipsoid of revolution sections coincide with the focal point of the other concave mirror. By providing this type of star-shaped configuration of light sources, which all combine their light beams in one shared bundle via the other concave mirror in accordance with the same principle, a reflector emitter is realized, which is designed for producing a strong, directed light beam using a plurality of lower-luminosity lamps. The luminance of the LEDs is significantly lower than that of incandescent lamps. Thus, the use of a plurality of lower-luminosity lamps in a common reflector emitter is preferred.

In accordance with a further embodiment of the reflector emitter according to the present invention, it may be provided for the other concave mirror to be linearly extended and for the combination reflector to have at least two ellipsoid of revolution sections which are located in the common plane of reference and are distributed around the extended, other concave mirror in such a way that the focal points located outside of the ellipsoid of revolution sections coincide with the linear focal line of the extended, other concave mirror. By distributing the outwardly disposed focal points of the ellipsoid of revolution sections on the focal line, a shaped light beam having an expanded width is achieved. Moreover, by varying the dimensions of the ellipsoid of revolution sections and the arrangement thereof, sorted by size, around the other concave mirror, it is possible to obtain light beams of varying beam spread and luminance distribution. Therefore, when another embodiment of the reflector emitter according to the present invention provides that the other concave mirror be adjustable in the diameter, outer shape and focal point thereof, or that at least one point of the focal line thereof be adjustable around the plane of reference, the light beam may then be even more extensively adjusted in terms of the shape, directional and luminance distribution thereof for greatly differing application purposes. Shifting the focal point of the other concave mirror out of the common plane of reference makes it possible to produce a converging or diverging light beam, in addition to the projection into infinity. In this context, other embodiments of the reflector emitter according to the present invention may provide that manual or motor-driven positioning devices with or without remote control be used for the adjustment.

Moreover, other embodiments of the reflector emitter according to the present invention may provide that the reflector emitter have an at least two-part design, the ellipsoid of revolution sections and the aperture being configured in an upper portion, and the further concave mirror and the lamp sockets being configured in a lower portion, and the upper and lower portions being permanently joined together, both the plane of separation between the upper and lower portion, as well as the aperture, which has a transparent cover, being sealed to the outside. The separation is significant, on the one hand, with regard to manufacturing the combination reflector and, on the other hand, with regard to replacing a lamp during operation. For an underwater use, an O-ring or a permanently flexible sealing compound is provided, for example, for sealing the plane of separation between the upper and lower portion, and a window, which is installed imperviously and, as the case may be, in a pressure-resistant manner is provided for sealing the aperture. It may also be provided that the light sources radiate light from the same or different spectral regions. This makes it possible to adjust the light color by mixing light in the distance. It may also be provided for the light sources to be halogen lamps or fluorescent lamps and for the transparent cover of the aperture to hold back or prevent the transmission of UV radiation and/or infrared radiation. Any light source may be used for which sizes that fit into the reflector can be obtained. The transparent cover as a window may be made of any transparent material which can be designed to be flat or curved and, if indicated, pressure-resistant. Finally, other embodiments of the reflector emitter according to the present invention may also provide that the cavities of the elliptical mirror and of the further concave mirror be cast in transparent form or from solid material and that the boundary surfaces be mirrorized, except for the transmission surfaces for the light sources and the aperture.

FIG. 1 shows a reflector emitter RS including an upper portion RO having two elliptical concave mirrors EH as ellipsoid of revolution sections RE and a round aperture RA, and a lower portion RU having another concave mirror WH and light sources LQ in focal points BA of elliptical concave mirror EH which face away from each other. The mutually facing focal points BZ and focal point BP of the other concave mirror WH, sectional planes SE of elliptical concave mirror EH and sectional plane SW of other concave mirror WH coincide in common plane of reference GG. Openings OE of the elliptical concave mirror and opening OW of other concave mirror WH oppose one another. Round aperture RA is centrally disposed above other concave mirror WH. Light sources LQ in focal points BA, which face away from one another, emit light beams LS, whose main component LH strikes elliptical concave mirror EH in corresponding ellipsoid of revolution section RE; from there, they are reflected by mutually facing focal points BZ into other concave mirror WH, and, subsequently, all exit the same as a parallel bundle PB through round aperture RA. Residual component LR of light beams LS exiting light sources LQ is absorbed within reflector emitter RS or emerges as scattered radiation SS from reflector emitter RS through round aperture RA. Upper portion RO and lower portion RU of reflector emitter RS are permanently joined together at common plane of reference GG by connecting elements VE, indicated here by dot-dash lines as screw connections SR, and sealed by a sealing element DE, indicated here as an O-ring seal OR, for example, against water that is under pressure. At round aperture RA, reflector emitter RS is sealed by a transparent cover TA, which is likewise sealed, for example, against water that is under pressure by a sealing element DE that is also represented here as O-ring seal OA, and is held by a pressure ring DR that is fixed in position by connecting elements VE, indicated here by dot-dash lines as screw connections SA, in upper portion RO. An energy source to operate reflector emitter RS, for example an electrical lead or battery container, may also be provided.

Figure 2:
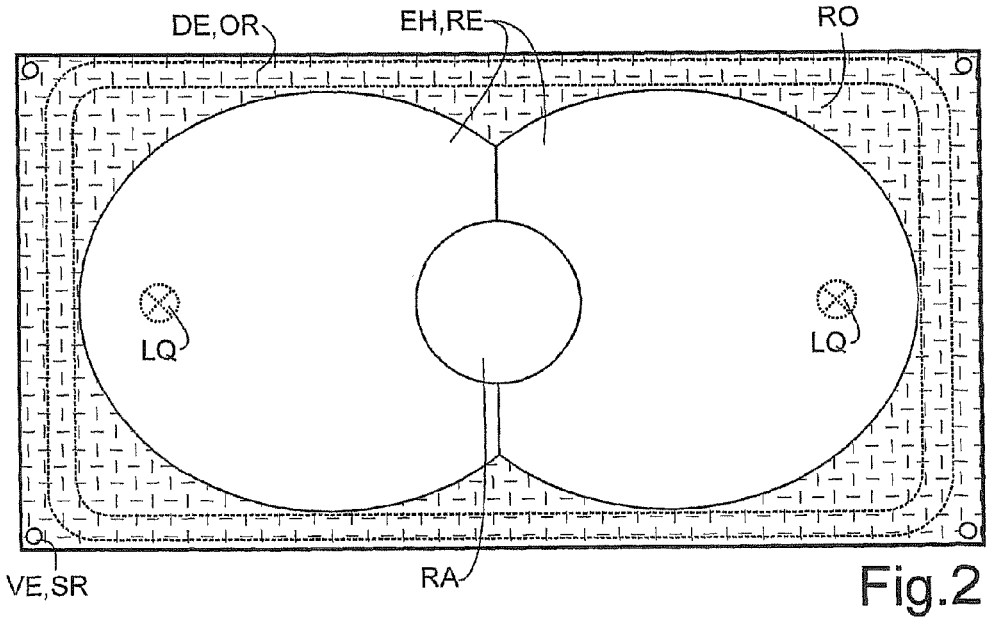
FIG. 2 shows an upper portion of a reflector emitter having two elliptical concave mirrors in a view from below.

FIG. 2 shows an upper portion RO of a reflector emitter RS having two elliptical concave mirrors EH in a view from below. The representation corresponds to the sectional view along plane A-B in FIG. 1. Visible here are both elliptical concave mirrors EH as ellipsoid of revolution sections RE and round aperture RA configured in the center thereof. The positions of light sources LQ in lower portion RU are indicated by a broken line, as is equally the position of sealing element DE, selected in this exemplary embodiment as O-ring seal OR., The receiving bores for connecting elements VE are shown as screw connections SR.

Figure 3:
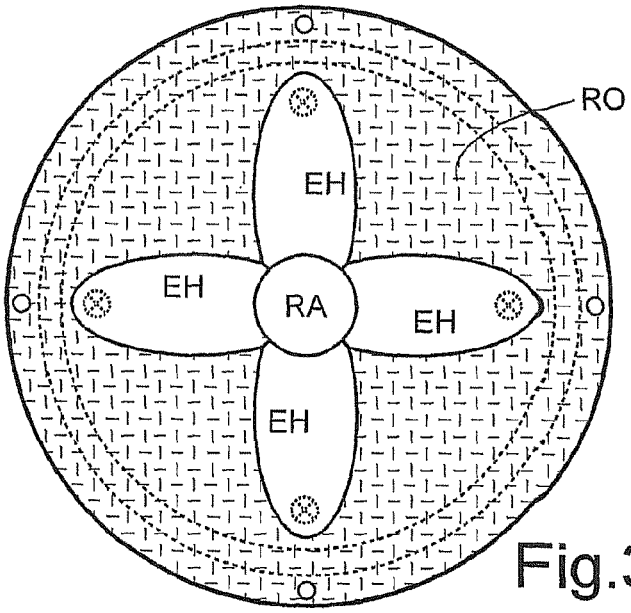
FIG. 3 shows an upper portion of a reflector emitter having four elliptical concave mirrors in a view from below.

FIG. 3 shows an upper portion RO of a reflector emitter RS as an exemplary embodiment having four elliptical concave mirrors EH in a view from below.

Figure 4:
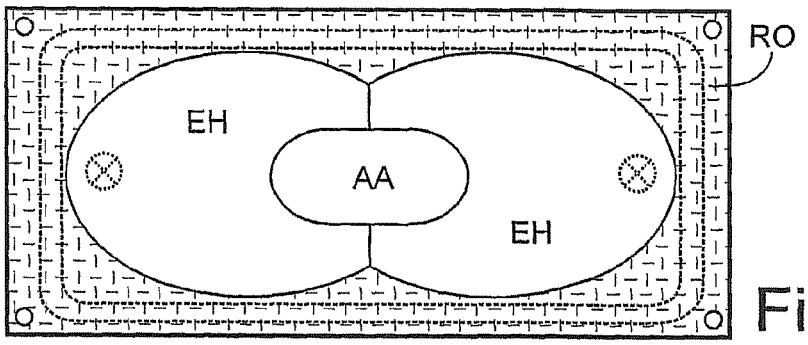
FIG. 4 shows an upper portion of a reflector emitter having two elliptical concave mirrors and an extended aperture in a view from below.

FIG. 4 shows an upper portion RO of a reflector emitter RS as an exemplary embodiment having four elliptical concave mirrors EH and an extended aperture AA in a view from below.

Figure 5:
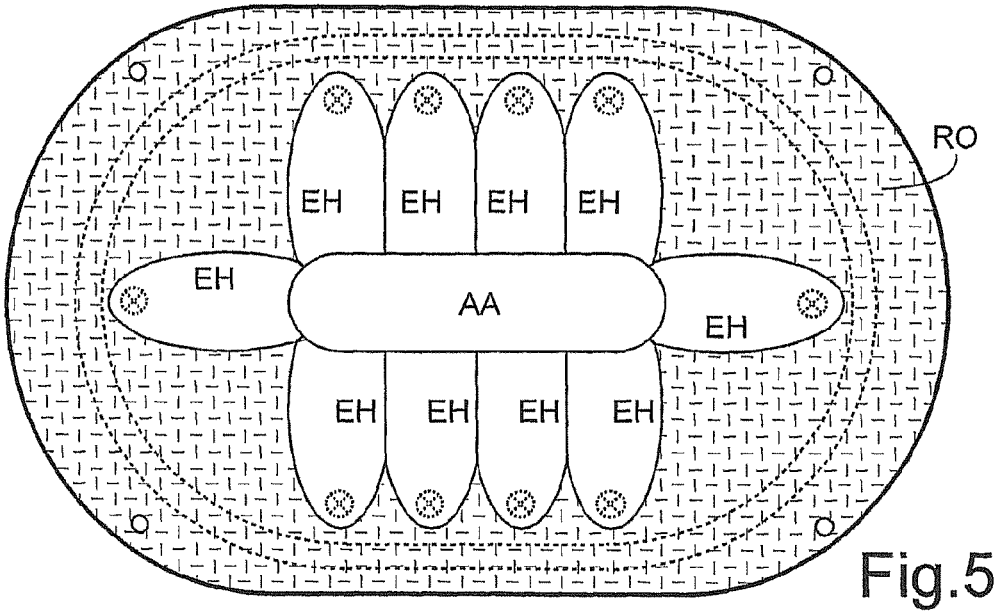
FIG. 5 shows an upper portion of a reflector emitter having ten elliptical concave mirrors and an extended aperture in a view from below.

FIG. 5 shows an upper portion RO of a reflector emitter RS as an exemplary embodiment having ten elliptical concave mirrors EH and an extended aperture AA in a view from below.

Like components are similarly shown and/or designated, but not all components are labeled in all views. While the invention has been described with reference to particular embodiments thereof, it will be understood by those having ordinary skill the art that various changes may be made therein without departing from the scope and spirit of the invention.

LIST OF REFERENCE NUMERALS

AA extended aperture
BA focal points facing away from one another
BP focal point
BZ mutually facing focal points
DE sealing element
DR pressure ring
EH elliptical concave mirror
GG common plane of reference
LH main component of the light beams
LQ light source
LR residual component of the light beams
LS light beams
OA O-ring seal aperture
OE openings of the elliptical concave mirror
OR O-ring seal upper/lower portion
OW opening of the other concave mirror
PB parallel bundle
RA round aperture
RE ellipsoid of revolution section
RO upper portion
RS reflector emitter
RU lower portion
SA screw connections
SE sectional planes of the elliptical concave mirror
SR screw connections upper/lower portion
SS scattered radiation
SW sectional plane of the other concave mirror
TA transparent cover
VE connecting elements
WH other concave mirror

The invention claimed is:

1. A reflector emitter for producing a directed light beam, comprising:

a combination reflector including:

at least two elliptical concave mirrors each having a form of a section of an ellipsoid of revolution having first and second focal points, each of the elliptical concave mirrors being cut, between its center and the first focal point, in a longitudinal section plane extending through the focal points and in a cross-sectional plane perpendicular to a line connecting the focal points so as to form at least two ellipsoid of revolution sections each having the first and second focal points disposed outside and inside of the ellipsoid of revolution section, respectively;

an other concave mirror having at least one focal point that coincides with the first focal point of each of the ellipsoid of revolution sections, the other concave mirror having a form of a hollow body cut in a sectional plane through the at least one focal point; and an aperture disposed vertically above the other concave mirror; and at least one light source disposed at the second focal point of each of the ellipsoid of revolution sections, wherein the longitudinal section plane of the ellipsoid of revolution sections and the sectional plane of the other concave mirror are disposed in a common plane of reference, and wherein the at least two elliptical concave mirrors and the other concave mirror have respective faces that oppose each other such that, with respect to the plane of reference, the directed light beam exits through the aperture on the same side of the plane of reference as the at least two elliptical concave mirrors.

2. The reflector emitter according to claim 1, wherein the at least one light source is a light-emitting diode.

3. The reflector emitter according to claim 1, wherein the at least two elliptical concave mirrors and the aperture are disposed in an upper portion of the reflector emitter and the other concave mirror and mounts for the at least one light source are disposed in a lower portion of the reflector emitter.

4. The reflector emitter according to claim 3, wherein the upper and lower portions are affixed to one another and sealed together, and wherein the aperture includes a transparent cover sealed thereon.

5. The reflector emitter according to claim 1, wherein the at least one light source disposed at the second focal point of each of the ellipsoid of revolution sections radiate light from a same spectral region.

6. The reflector emitter according to claim 1, wherein the at least one light source disposed at the second focal point of each of the ellipsoid of revolution sections radiate light from different spectral regions.

7. The reflector emitter according to claim 1, wherein the at least one light source is at least one of a halogen lamp and a fluorescent lamp.

8. The reflector emitter according to claim 1, wherein the aperture includes a transparent cover disposed thereon which prevents transmission of at least one of ultraviolet radiation and infrared radiation.

9. The reflector emitter according to claim 1, wherein cavities of the at least two elliptical concave mirrors and the other concave mirror are transparent.

10. The reflector emitter according to claim 1, wherein cavities of the at least two elliptical concave mirrors and the other concave mirror are formed from solid material.

11. The reflector emitter according to claim 9, wherein surfaces of the at least two elliptical concave mirrors and the other concave mirror are mirrorized and transmission surfaces for the at least one light source and the aperture are not mirrorized.

12. The reflector emitter according to claim 10, wherein surfaces of the at least two elliptical concave mirrors and the other concave mirror are mirrorized and transmission surfaces for the at least one light source and the aperture are not mirrorized.

13. A reflector emitter for producing a directed light beam, comprising:

a combination reflector including:

at least two elliptical concave mirrors each having a form of a section of an ellipsoid of revolution and having first and second focal points, each of the at least two elliptical concave mirrors being cut, between a center and the first focal point, in a longitudinal section plane extending through the focal points and in a cross-sectional plane perpendicular to a line connecting the focal points so as to form at least two ellipsoid of revolution sections having the first and second focal points disposed outside and inside of the ellipsoid of revolution sections, respectively;

an elongated other concave mirror extending linearly so as to include at least one focal line that coincides with the first focal points of each of the ellipsoid of revolution sections, the other concave mirror having a form of a hollow body cut in a sectional plane through the at least one focal line; and an aperture disposed vertically above the other concave mirror; and at least one light source disposed at each of the second focal points of the ellipsoid of revolution sections, wherein the longitudinal section plane of the ellipsoid of revolution section and the sectional plane of the other concave mirror are disposed in a common plane of reference, and wherein the at least two elliptical concave mirrors and the other concave mirror have respective faces that oppose each other.

* * * * *